United States Patent [19]

Penney

[11] 4,404,800

[45] Sep. 20, 1983

[54] GAS ENERGIZED ENGINE SYSTEM

[76] Inventor: Edison P. Penney, 3750 Underwood Blvd., Houston, Tex. 77025

[21] Appl. No.: 187,800

[22] Filed: Sep. 16, 1980

[51] Int. Cl.[3] ..... F15B 11/06

[52] U.S. Cl. ..... 60/370; 60/374; 60/375; 60/378; 60/412; 60/419

[58] Field of Search ..... 60/370, 374, 375, 378, 60/412, 419; 417/399, 400; 180/302

[56] References Cited

U.S. PATENT DOCUMENTS 3,765,180 10/1973 Brown ..... 60/374 X 4,124,978 11/1978 Wagner ..... 60/412 X

*Primary Examiner*—Gerald A. Michalsky

*Attorney, Agent, or Firm*—Gunn, Lee & Jackson

[57] ABSTRACT

A Gas Energized Engine System, according to the present invention, is adapted to drive a piston type gas energized engine having a piston and cylinder system that is operatively interconnected with a crankshaft that transmits rotary force to any suitable load. The piston type engine is provided with gas intake and exhaust systems. The gas intake system is interconnected with a gas supply system having a high pressure supply vessel and an operating pressure supply vessel that are interconnected by a pressure regulator. A converter system which is an engine and compressor system that is separate from the gas energized engine, and has a gas inlet that receives the exhaust of the gas exhaust system of the engine and functions to compress the exhaust gas to a high pressure and communicate the high pressure to the high pressure vessel of the gas supply system and to modify the exhaust atmosphere of the gas energized engine. The converter system is energized by gas transmitted thereto by the operating pressure gas supply. The converter system is driven by a plurality of linear hydraulic motors that are interconnected to a common crankshaft along with a plurality of linear hydraulic compressors of the converter system. The linear hydraulic motors are actuated in response to a valving system that is energized in response to crankshaft movement. The gas energized engine system is a substantially closed loop system with energy losses due to seal leakage, friction losses and the like being continuously replenished.

25 Claims, 4 Drawing Figures

BALLAST TANK
170
172
174
10
12
14
16
18
20
22
24
26
28
30
32
34
36
38
40
42
44
46
48
50
52
54
55
56
58
60
62
64
66
68
70
72
74
76
78
80
82
84
86
88
90
92
94
96
98
100
102
104
106
108
110
112
114
116
118
120
122
124
126
128
130
132
134
136
140
142
144
146
148
150
152
154
156
158
160
164
165
166
168

3
78
110
238
252
222
194
226
220
224
210
198
154
144
302
300
128
232
234
316
240
276
244
208
308
204
242
304
212
214
306
216
218
228
230
312
314
310
280
180
188
262
236
290
178
277
264
266
186
268
270
182
184
272
284
274
190
286
192
288
176
282
202
278
298
256
292
200
118
294
196
260
296
197
199
3

GAS ENERGIZED ENGINE SYSTEM

FIELD OF THE INVENTION

This invention relates generally to power supply systems such as engines and more particularly, relates to gas energized engine systems, such as air driven, steam driven, etc. Even more specifically, the present invention is directed to a gas energized engine system having closed loop feedback characteristics wherein the exhaust of the engine is converted to high pressure and is then transmitted to a gas supply system from which the engine derives its operating pressure.

BACKGROUND OF THE INVENTION

Internal combustion engines provide both portable and stationary power sources that have materially enhanced the development of the industry throughout the world. It is well known, however, that internal combustion engines are relatively inefficient and make use of only a portion of the available energy that may be derived from fossile fuels and other fuels available for operation thereof. In recent years, especially in view of the increasing costs of fuels, most engine manufacturers have undertaken the development of more efficient engine systems. In most cases however, such developments have been in the nature of improving various characteristics of internal combustion engines such as fuel metering, carburetion, fuel injection, valve control, fuel ignition, etc. Although many advantageous results have been achieved toward fuel economy, nevertheless, the cost of fuel represents a material disadvantage to practical utilization of internal combustion engines. It is desirable therefore, to provide an engine system that minimizes utilization of various types of fuels and yet provides an engine system having a power output that may be utilized as efficiently as the power output of conventional internal combustion engines.

SUMMARY OF THE INVENTION

It is a primary feature of the present invention to provide a novel engine system that is driven by compressed gas and does not require direct application of a fossil fuel energy source for the purpose of operating the engine system.

It is a also a feature of this invention to provide a novel engine system that functions efficiently and achieves significantly greater energy output per unit of fuel required, thereby resulting in significant energy savings as compared to conventional internal combustion engines.

It is also a feature of this invention to provide a novel engine system that functions efficiently through utilization of cool compressed gas for operation thereof, thus effectively obviating the damaging effects of heat that ordinarily occurs with virtually every type of commercially available engine system.

Other and further objects, advantages and features of the invention will become obvious to one skilled in the art upon an understanding of the illustrative embodiment about to be described and various advantages not referred to herein will occur to one skilled in the art upon employment of the invention in practice.

Briefly, the present invention is directed to a gas driven engine system incorporating a piston driven type gas energized engine that is powered by a source of compressed gas. The gas energized engine incorporates cylinders having pistons that reciprocate therein with pistons being interconnected in operative relation with a crankshaft that also represents the rotary power output of the gas driven engine. Operation of the engine is controlled by means of inlet and discharge valves such as may be controllably operated by cams, lifters or any other suitable mechanical valve control apparatus.

The inlet valves of the gas driven engine are interconnected with an operational supply vessel or tank which, for example, may be maintained within a suitable operational pressure range having a high pressure limit of approximately 200 psig. The operational supply vessel is in turn interconnected with a high pressure supply vessel which, for example, may be maintained at a pressure range in the order of 250 to 500 psig.

In order to replenish the high pressure supply vessel with pressure depleted by the operational supply vessel for operation of the piston energized engine, a converter system is employed which is an engine and gas compressor system which is mechanically separate from the gas driven engine and is interconnected with the gas driven engine only by a conduit system that serves only to establish gas communication between the gas supply system, engine and converter. The converter system is provided with a plurality of linear air engines that are interconnected in driving relation with a crankshaft and sequentially controlled by means of a plurality of cam actuated control valves that are operated responsive to rotation of the crankshaft. An outlet of the high pressure supply vessel is coupled with the control valve system for the purpose of sequentially communicating high pressure to the respective inlets of the linear gas motors. The discharge of each of the linear gas motors is coupled with a manifold that is interconnected with the operational supply vessel to replenish gas pressure depleted therefrom for the reason that the discharge pressure of the linear gas motors is higher than the pressure of the operational supply vessel.

The converter system also incorporates a plurality of linear gas compressors which include operator shafts that are also operatively coupled to the crankshaft of the converter. Each of the linear gas compressors includes an inlet that is coupled with the exhaust of the gas energized piston engine. The suction of the linear compressors is employed to modify the exhaust atmosphere of the gas energized engine so that its efficiency is controlled by the characteristic of the modified atmosphere in communication with the exhaust system of the engine. A vacuum valve is incorporated within the intake supply of the linear gas compressors and functions to maintain the inlet pressure of the compressors and thus the modified exhaust atmosphere of the gas driven engine as near vacuum as possible. A ballast vessel is also incorporated in the inlet supply of the linear gas compressors and functions cooperatively with the vacuum valve system to insure vacuum or near vacuum characteristics of the pressure at the inlet of each of the gas compressors. The discharge of each of the gas compressors is coupled to the high pressure supply vessel for the purpose of maintaining the high pressure supply vessel within its operative pressure range.

In order to resupply the operational pressure system with pressure that is lost due to seal leakage, frictional power losses, etc., the converter system is provided with a recompressor power source that is driven by the crankshaft of the converter. The output of the recompressor is communicated with the high pressure supply vessel. An auxilliary compressor may also be employed to provide pressure for the high pressure supply vessel. The auxilliary compressor has its inlet communicated with the exhaust system of the piston energized engine mechanism and with its discharge communicated directly with the high pressure supply vessel.

BRIEF DESCRIPTION OF THE DRAWINGS

In order that the manner in which the above recited advantages and objects of the invention are obtained and can be understood in detail, more particular description of the invention briefly summarized above, may be had by reference to the specific embodiments thereof that are illustrated in the appended drawings, which drawings form a part of this specification. It is be understood, however, that the appended drawings illustrate only the typical embodiments of the invention and, therefore, are not to be considered limiting of its scope, for the invention may admit to other equally effective embodiments.

IN THE DRAWINGS

Figure 1:
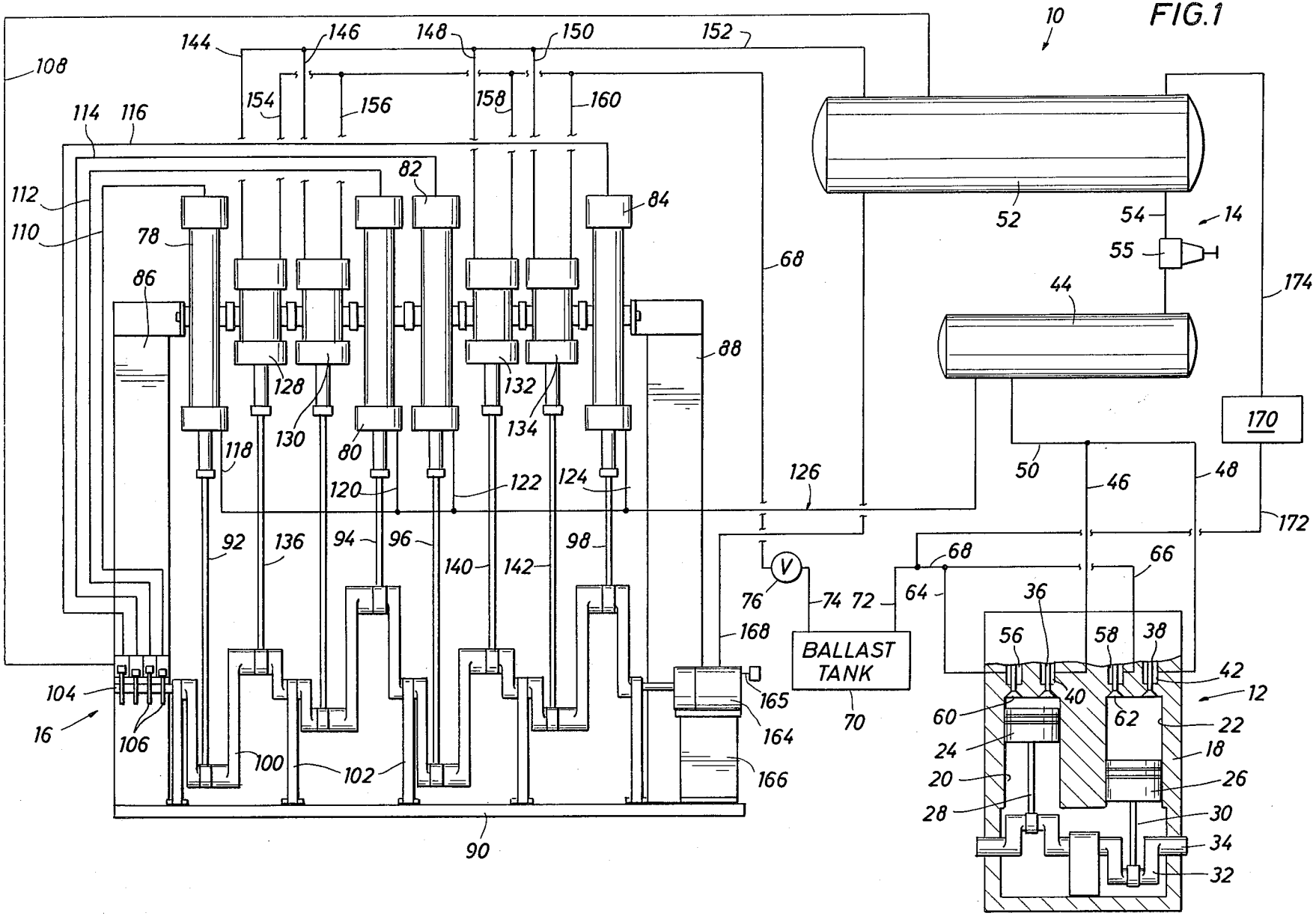

FIG. 1 is a partially mechanical and partially schematic illustration of a gas driven engine system that is constructed in accordance with the present invention.

Figure 2:
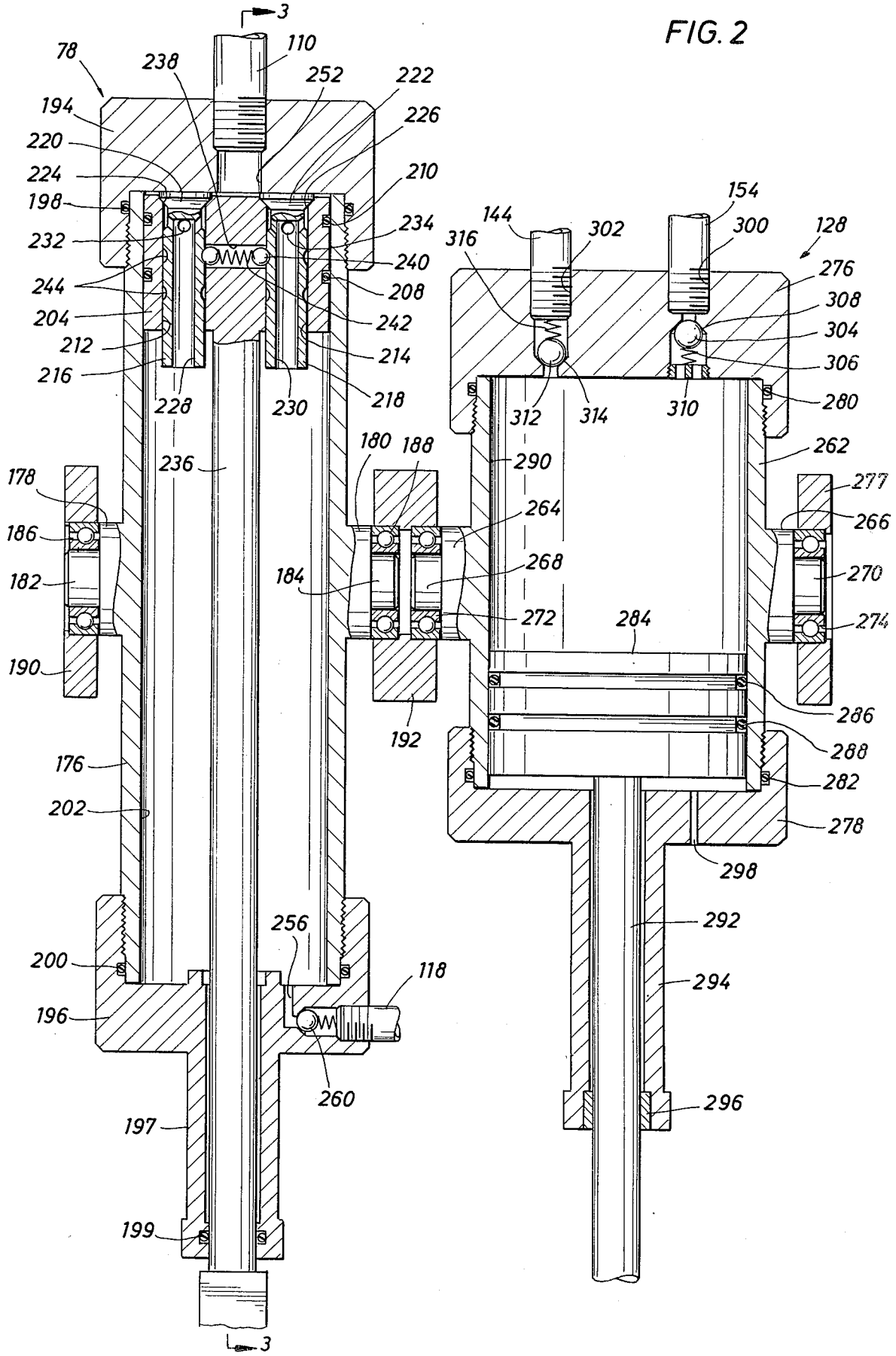

FIG. 2 is a sectional view of a linear gas motor and a linear gas compressor that comprise a portion of the engine system of FIG. 1 and illustrate the piston and valve systems of the linear gas motor and linear gas compressor respectively at the upper and lower positions thereof within the respective cylinders.

Figure 3:
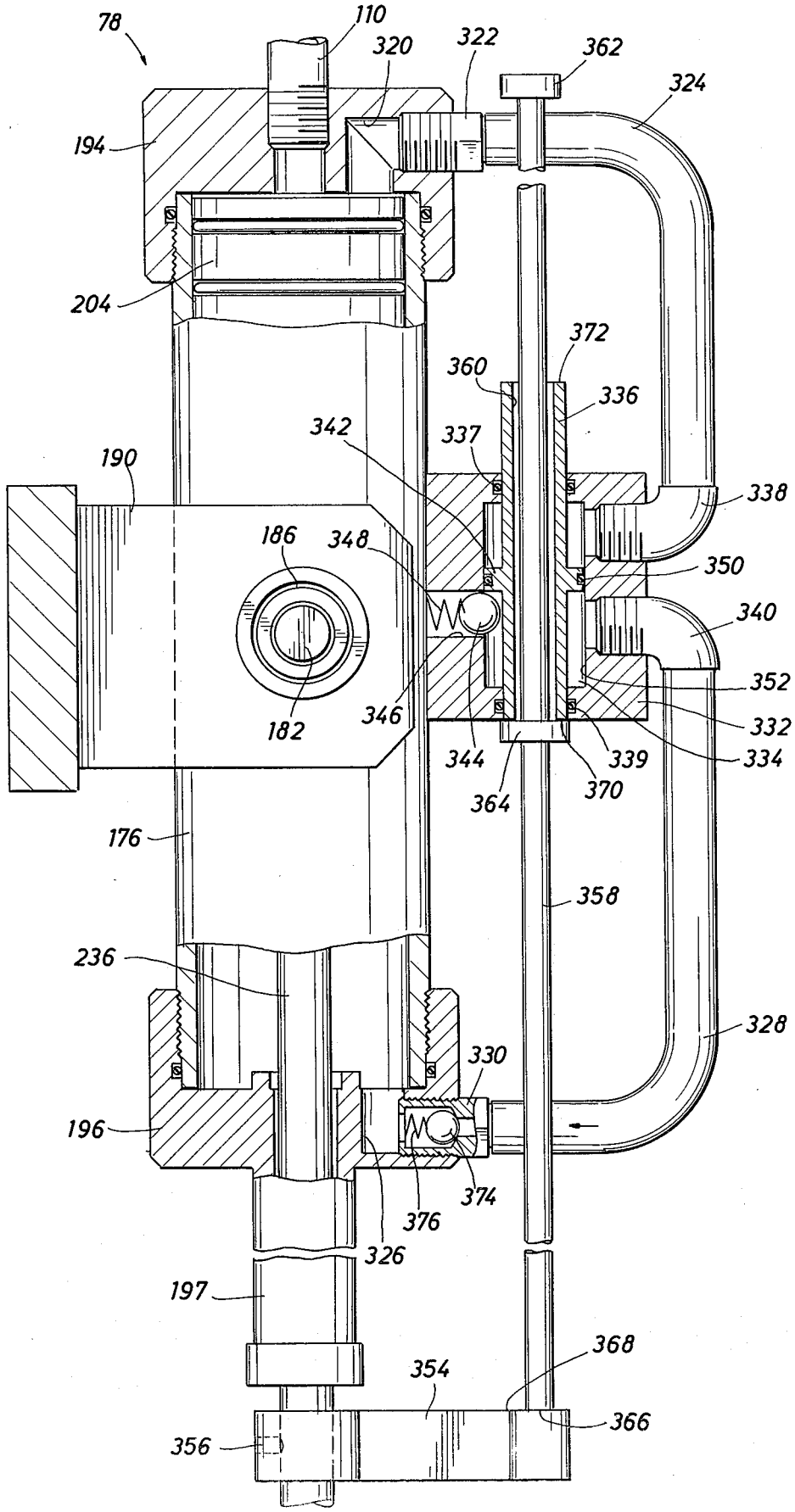

FIG. 3 is a sectional view of the linear gas motor structure of FIG. 2 taken along line 3—3 of FIG. 2 and further illustrating the valve controlled gas bypass feature thereof in detail.

Figure 4:
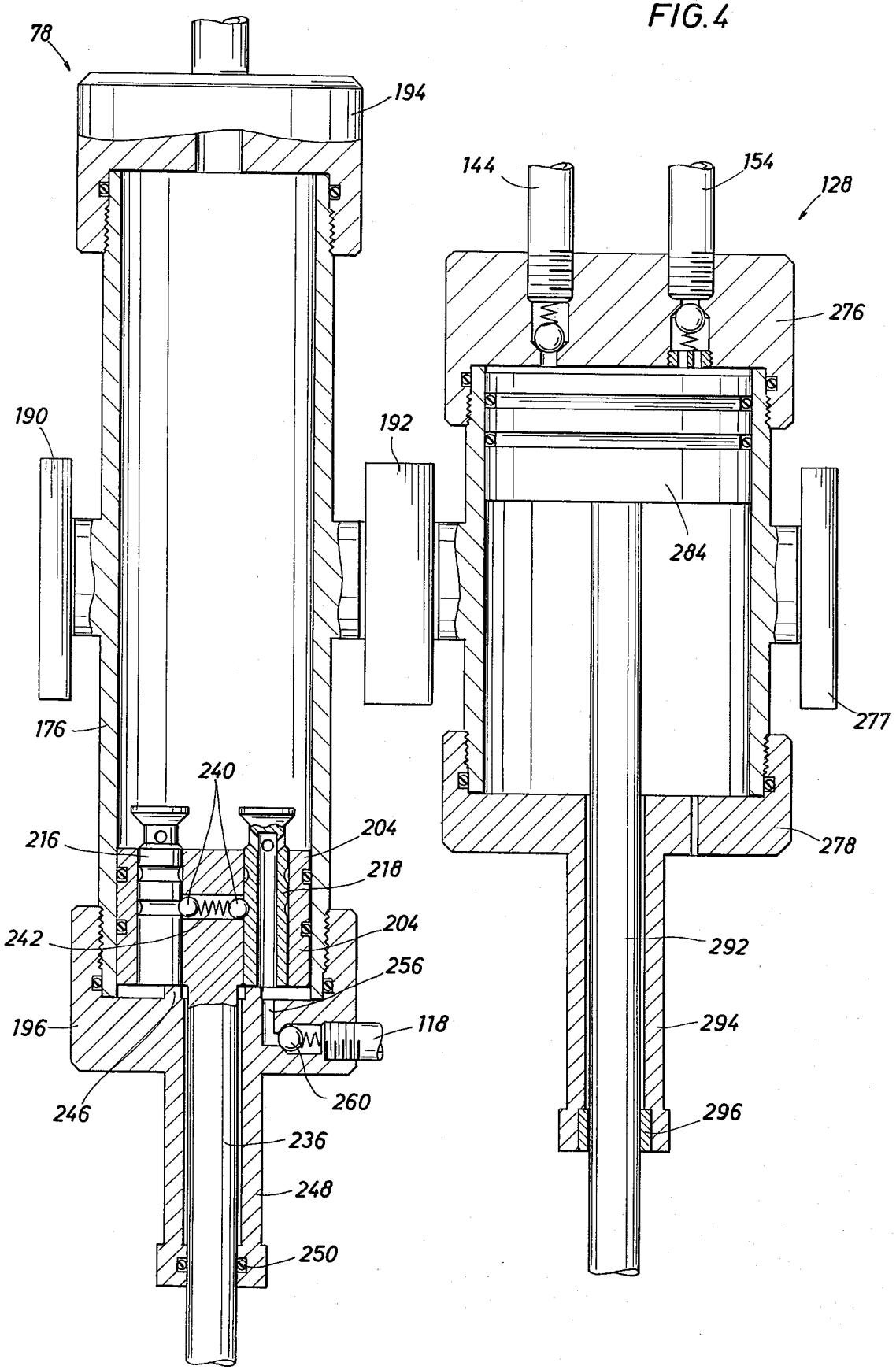

FIG. 4 is a partial sectional view illustrating the linear gas motor and linear gas compressor of FIG. 2 and illustrating the respective piston and valve systems thereof at the opposite extremities within the respective cylinders.

DETAILED DESCRIPTION OF PREFERRED EMBODIMENT

Referring now to the drawings and first to FIG. 1, there is shown a substantially closed loop gas driven engine system generally at 10 having a power output engine shown generally at 12, a gas pressure supply system generally at 14 and a gas converter system generally at 16. The gas driven engine system is adapted to be energized completely by pressurized gas within particular operating pressure ranges for the various components thereof, with energy and pressure losses replenished by means of an auxilliary compressed gas supply system.

The gas driven power output engine 12 typically comprises an engine block 18 having piston bores formed therein as illustrated at 20 and 22. The pistons, such as illustrated at 24 and 26 are positioned for reciprocation within respective ones of the piston bores and are coupled by means of connecting rods 28 and 30 respectively to a crankshaft 32 that is journaled for rotation within the engine block. The crankshaft 32 includes a power output shaft portion 34 to which any suitable rotary load may be interconnected in such manner that the engine 12 provides power for the load.

As shown in the upper portion of the engine block 18 intake valves 36 and 38 are provided which control introduction of a pressurized gaseous medium into the cylinders 20 and 22 respectively for the purpose of driving the pistons downwardly to induce rotation to the crankshaft. Inlet valves 36 and 38 communicate with gas inlet chambers 40 and 42, respectively, which are in fluid communication with an operational pressure supply vessel 44 by means of supply conduits 46 and 48 which communicate with a supply manifold conduit 50.

The operational pressure supply vessel 44 is an integral part of the pressurized gas supply system 14 as mentioned above. A high pressure gas supply vessel 52 also forms an integral part of the gas pressure supply system 14 and is in communication with the operational pressure supply vessel 44 by means of a conduit 54, with pressure between the vessels being controlled by means of a pressure regulator 56. As explained above, the operational pressure range within the vessel 44 may be in the order of 150 to 200 psig while the pressure range within the high pressure supply vessel 52 may be in the order of 250 to 500 psig.

Referring again to the gas driven engine system 12, the piston block 18 is formed to define exhaust chambers 56 and 58 that are in communication with the cylinders 20 and 22. Exhaust of gas from the cylinders into the chambers 56 and 58 is controlled by means of exhaust valves 60 and 62, respectively. Both the inlet and exhaust valves are controlled in a timing sequence by a camshaft, not shown, which induces movement to the valves responsive to a rotational timing sequence of the crankshaft 32. Obviously, any other suitable mechanism for inducing controlled movement to the inlet and discharge valves of the engine 12 may be employed within the spirit and scope of the present invention. The exhaust chambers 56 and 58 are communicated with exhaust conduits 64 and 66, respectively, which communicate with an exhaust manifold 68. The exhaust manifold is in turn interconnected with a ballast vessel 70 by means of ballast inlet and outlet conduits 72 and 74. The exhaust manifold conduit 68 is provided with a vacuum valve 76 that functions to maintain the exhaust manifold as near a vacuum condition as is possible at all phases of engine operation. The purpose of the vacuum valve 76 will be described in more detail hereinbelow in regard to recompression of exhaust gas by means of linear compressors. One method of changing the efficiency of a conventional internal combustion engine or a similar gas driven piston engine is to vary the period during which pressure is being applied to the piston during the power stroke of the piston. In accordance with this invention, power may be applied to the piston during the entire power stroke thereof and the efficiency of the engine is controlled by modification of the exhaust atmosphere into which the cylinders exhaust at the end of each power stroke. Selective modification of the pressure of the exhaust atmosphere of the gas driven engine provides for controlled, efficient operation of the engine. As the gas driven engine 12 operates, the pressurized gas supply within the operational gas supply vessel 44 will be continuously depleted and continuously resupplied by means of the gas pressure within the high pressure supply vessel 52 under control of the regulator 55. Consequently, the pressure within the high pressure supply vessel 52 will be continuously depleted and must be replenished in order to maintain the particular operational pressure range thereof.

In accordance with the present invention a suitable means for continuously charging the high pressure supply vessel 52 with pressurized gas may conveniently take the form of a gas converter system illustrated generally at 16. It is important to note that the gas converter is mechanically separate from the mechanical structure of the engine and is interconnected therewith only by means of a conduit system for controlled transfer of gas during operation of the engine system. The gas converter system incorporates a plurality of linear gas energized motors which are shown at 78, 80, 82 and 84. Each of the motors are mounted for pivotal movement by motor and compressor support posts 86 and 88 that are in turn supported by a base structure 90. Each of the linear gas motors is provided with an internal piston movable within a cylinder defined by the respective motor and is also provided with piston shafts 92, 94, 96 and 98, respectively. The piston shafts of the motor are rotatably interconnected with a crankshaft 100 that is rotatably supported relative to the base structure 90 by means of a plurality of support posts 102 each having journals at the upper portion thereof having bearing engagement with respective crankshaft bearing surfaces. The crankshaft 100 is provided with a rotatable camshaft portion 104 having controlled engagement with a plurality of control valves 106, each communicating with a motor gas supply conduit 108 and controlling introduction of pressurized gas into individual motor operation conduits 110, 112, 114 and 116. As the camshaft 100 rotates, the control valves 106 are sequentially operated by the rotatable camshaft 104, thereby inducing controlled sequential operation of the respective gas energized linear motors 78, 80, 82 and 84. These motors, in turn, induce forcible rotation to the crankshaft 100 in much the same manner as the piston and connecting rod assemblies of a conventional internal combustion engine induce rotation to a crankshaft. Each of the linear gas motors is provided with an exhaust conduit such as shown at 118, 120, 122 and 124, respectively, which are interconnected with an exhaust manifold conduit 126. The exhaust manifold conduit is, in turn, connected to the operational gas supply vessel 44 as shown.

As explained above, the pressure of the high pressure supply vessel is maintained within an operational pressure range in the order of 250 to 500 psig. This high pressure is communicated by a conduit 108 and is then introduced into the linear gas motors under control of the valves 106. The pressure of the exhaust of each of the linear motor exceeds the pressure range of the operational gas supply vessel 44. Thus, the gas exhausted from the various linear gas motors functions to replenish the operational gas supply vessel and thus provide operational pressure for energization of the gas driven engine 12.

The gas converter system is also provided with a plurality of linear gas compressors as shown at 128, 130, 132 and 134 which are also pivotally supported by the support posts 86 and 88. Each of the linear compressors is provided with a piston that is movable within an internal cylinder with respective piston shafts or connecting rods 136, 138, 140 and 142 being connected by appropriate journals to varying portions of the crankshaft 100. The linear stroke of the linear compressors is significantly less than the linear stroke of the linear gas motors as is evident by the respective offset portions of the crankshaft 100. This feature insures tht as the linear gas motors are moved through their respective long strokes, inducing rotation to the crankshaft 100, the linear gas compressors are moved by the crankshaft through respective short strokes which achieve appropriate pressure enhancement to insure delivery of high pressure to the high pressure supply vessel 52. Each of the linear compressors is provided with a discharge conduit 144, 146, 148 and 150 that communicate respectively with a supply manifold conduit 152 that is, in turn, connected with the high pressure supply vessel 152 as shown. The pressurized output of the linear gas compressors is, therefore, fed directly to the high pressure supply vessel for the purpose of replacing gas depleted therefrom. Each of the linear compressors is also provided with respective inlet conduits 154, 156, 158 and 160 that are disposed in communication with the exhaust manifold conduit 68. The exhaust from the gas driven engine 12 is, therefore, fed to the inlet portions of each of the linear compressors. In view of the fact that the vacuum valve 76 maintains the pressure within the manifold conduit 68 at or near a vacuum condition, intake of gas into the respective compression chambers of the linear gas compressors is achieved with minimum expenditure of energy through the crankshaft 100.

One of the important features of this invention is exhaust atmosphere modification which is developed by the converter system and utilized for the purpose of controlling the operational efficiency of the gas driven engine. In steam engines, internal combustion engines and the like, the exhaust is communicated as efficiently as possible to the atmosphere to retard the development of back pressure which otherwise interferes with efficiency. In accordance with this invention, the suction of the compressors is employed to accomplish modification of the pressure of the region that is exhausted into from the cylinders of the engine thereby creating a modified exhaust atmosphere in the exhaust receiving region. This suction or vacuum condition is communicated in controlled manner to the exhaust manifold of the engine 12 and thus provides the engine with increased efficiency. The ballast tank 70 and vacuum valve 76 assist in insuring that the modified exhaust atmosphere remains substantially constant during all phases of engine operation.

A rotatable drive portion 162 of the crankshaft 100 is connected in driving relation with a recompressor mechanism 164 that is also supported relative to the base structure 100 by means of a support structure 166. The recompressor 164 is provided with an output conduit 168 that is in communication with the high pressure supply vessel 62. As the crankshaft 100 rotates, the recompressor mechanism 164 obtains gas from any suitable source such as air from the atmosphere for example. The recompressor pressurizes the gas and transmits it to the high pressure supply vessel 52 in order to compensate for energy depletion, seal leakage of the linear gas motors and compressors, friction losses, etc. An auxilliary compressor 170 may also be provided as shown in FIG. 1 having the inlet thereof communicated with the exhaust manifold 68 by means of a compressor supply conduit 172. A compressor discharge conduit 174 communicates the discharge of the auxilliary compressor 170 with the high pressure supply vessel 52. The auxilliary compressor 170 may be operatively energized under certain pressure conditions within the high pressure supply vessel 52 in order to insure maintenance of the pressure range within vessel 52 between 250 and 500 psig or within any other suitable pressure range that is appropriate to the energy system involved.

Referring now to FIG. 2, there is illustrated a sectional view of a gas energized linear motor as shown generally at 78 and a linear gas compressor as generally shown at 128. The linear motor 78 incorporates a cylinder wall 176 having intermediate opposed bosses 178 and 180 machined to such manner as to define bearing support spindles 182 and 184 that receive the inner race of respective bearings 186 and 188. Bearing receptacles are provided as shown at 190 and 192 which receive the outer race portions of the respective bearings and, thus, provide for pivotal movement of the cylinder 176. The cylinder 176 is also provided with upper and lower end caps 194 and 196 which are threadedly received by upper and lower portions of the cylinder and are sealed with respect to the cylinder by upper and lower sealing elements 198 and 200 respectively. The cylinder 176 is formed to define an internal cylindrical wall 202 within which is movably received a piston 204 having piston seals 208 and 210 that establish sealed engagement between the piston and the cylindrical surface 202. The piston 204 is formed to define valve bores 212 and 214 within which are movable disposed poppet valves 216 and 218 having upper sealing portions 220 and 222 thereof that engage seat surfaces 224 and 226 that are defined at the upper portion of each of the valve bores. The valves are formed to define internal passages or blind bores 228 and 230 that are intersected by a plurality of ports 232 and 234. With the sealing head surface portions 220 and 222 of the respective valves unseated from seat surfaces 224 and 226, pressure above the piston 204 is communicated through the ports 232 and 234 and flows through the respective valves 216 and 218 through the passages 228 and 230.

The piston 204 is supported by means of a piston shaft 236 which is formed to define a transverse bore 238 receiving a pair of ball detent elements 240 that are urged in opposing directions by means of a compression spring 242. Each of the valve elements is formed to define spaced external grooves such as shown at 244 within which the ball detent elements 240 are received for the purpose of establishing releasable locking of the valve elements 216 and 218 with respect to the piston structure 204. The valve elements 216 and 218 may be locked in the position shown in FIG. 2 or in the position shown in FIG. 4 and will remain so positioned until such time as forcibly shifted to the opposite position responsive to positioning of the piston 204 at the upper or lower positions thereof. As shown in FIG. 2, the piston 204 is at its uppermost position thereby causing the upper portions of the valve elements 216 and 218 to contact the end cap 194, thus shifting them downwardly with respect to the piston and causing the locking detents 240 to enter the upper locking grooves in the respective valves. As shown in FIG. 4, the piston 204 has moved downwardly within the cylinder 176 to the full extent of its movement, thereby causing an upwardly projecting internal portion 246 of the lower end cap 196 to engage the lower portions of the valves 216 and 218 thereby shifting them upwardly and causing the locking detents 240 to enter the lower valve positioning groove each of the valves. The influence of the compression spring 242, acting upon the ball detents 240, causes the ball detents to lock the valve elements 216 and 218 at the upper positions thereof relative to the piston 204.

The piston shaft 236 extends through an axially extending portion 248 of the lower end cap 196. An annular sealing element 250 maintains a sealed relationship between the end cap and the piston shaft. The upper end cap 194 is provided with a gas inlet passage 252 and a pressurized gas supply conduit 110 is connected to the end cap 194 by threading or by any other suitable form of connection and introduces pressurized gas through the passage 252 into the cylinder 176. As pressurized gas is introduced into the upper portion of the cylinder, with the poppet valves 216 and 218 closed as shown in FIG. 1, the piston 204 is driven downwardly, thereby moving the piston shaft 236 downwardly. As this occurs, exhaust gas present within the cylinder below the piston is forced through an outlet passage 256 into any exhaust conduit 118 under the control of a spring-biased check valve 260.

At the right side portions of each of FIGS. 2 and 4 are shown linear compressors illustrated generally at 128. Each of the linear compressors incorporates a compressor cylinder 262 that is formed intermediate the extremities thereof to define bosses 264 and 266 that are machined in such manner as to define bearing support spindles 268 and 270. Bearing elements 272 and 274 are received by the respective spindles and are also received by bearing receptacles 192 and 276, thereby providing pivotal support for the cylinder with respect to the bearing receptacles 192 and 276. As shown in FIG. 1, the respective spindles, bearings and bearing supports of each of the linear gas motors and linear compressors are coupled in such manner that they are pivotal with respect to one another in much the same manner as if a single pivot shaft extended through each of them and supported them relative to the posts 86 and 88. As the connecting rods or piston shafts of each of the linear motors and linear compressors reciprocates during rotation of the crankshaft 100, the respective cylinders pivot or rock back and forth due to the swinging movement of the respective connecting rods. Obviously, if it is required that the cylinders of the linear motors and compressors remain stationary, it will be necessary to establish an articulated connection between the respective connecting rods and pistons such as is within the spirit and scope of the present invention.

The upper and lower portions of the cylinder 262 are externally threaded and provided for threaded connection of upper and lower end caps 276 and 278 in assembly with the cylinder. The end caps are sealed with respect to the cylinder by means of upper and lower sealing elements 280 and 282.

A piston element 284 is positioned for linear movement within the cylinder 262 and is provided with upper and lower external seals 286 and 288 that establish a sealed relation between the piston and an internal cylindrical surface 290 defined within the cylinder. The piston 284 is coupled to a piston shaft 292 which extends through a downwardly projecting portion 294 of the lower end cap 278. A dust cover or dust seal 296 is received within a receptacle defined in the lower portion of the depending cap portion 294 and functions to prevent dust and other debris from entering the piston chamber of the compressor beneath the piston 284. The lower end cap 278 of the compressor cylinder is formed to define a vent passage 298 through which gas is vented as the piston 284 reciprocates within the cylinder. The upper end cap 276 is formed to define inlet and outlet passage ways 300 and 302 respectively receiving inlet and discharge conduits 154 and 144 respectively. Within the inlet passageway 300 is retained a ball type check valve 304 which is maintained by a compression spring 306 against a seat surface 308. The ball detent is maintained within a suitable check valve chamber by means of a retainer element 310 that is ported to allow passage of gas therethrough under circumstances where the valve 304 is forced open by exhaust gas being drawn into the cylinder by downward movement of the piston 284. In the outlet passageway 302, a ball type check valve 312 is provided which is maintained against a valve seat 314 by means of a compression spring 316. As the piston 284 moves upwardly during its compression stroke, the check valve 304 will be closed not only by the force of the compression spring 306, but also by differential pressure acting across the check valve 308. Simultaneously, the check valve 312 will be unseated by the force of pressure within the cylinder, thereby causing the compression spring 316 to yield, allowing the check valve 312 to move upwardly and thereby allowing flow through the discharge passage 302 into the discharge conduit 144.

Referring now to FIG. 3 which is a sectional view taken along line 3—3 of FIG. 2, each of the linear gas motors is provided with a valve control bypass system that allows bypassing of gas from the top to the bottom of the cylinder and vice-versa, depending on direction of piston movement. The upper end cap 194 of the linear gas energized motor 78 is formed to define a bypass passage 320 having the outer portion thereof internally threaded and adapted to receive an externally threaded connector and check valve portion 322 of the bypass conduit 324. Likewise, the lower end cap 196 is formed to define a bypass passage 326 that is maintained in communication with a bypass conduit section 328 and with a spring urged check valve 330 controlling communication between the bypass conduit section 328 and the lower portion of the cylinder 176. The bypass system incorporates a bypass valve body structure 332 that is formed to define an internal valve chamber 334 that receives a shuttle valve 336 in linearly movable relation therein. Bypass conduit connector portions 338 and 340 are received by the valve body structure 332 and communicate with upper and lower portions of the bypass valve chamber 334. The shuttle valve 336 is provided with an enlarged intermediate partition 342 that may be positioned between the bypass connectors 338 and 340 as shown in FIG. 3 or, in the alternative, may be shifted downwardly to a position below the lowermost connector 340, thereby allowing communication between bypass sections 324 and 328. The shuttle valve is sealed with respect to the body structure 322 by means of annular sealing elements 337 and 339 that may take the form of O-rings or any other suitable annular seals.

It is desirable that the shuttle elements 336 be capable of remaining in a preselected position, either preventing bypass of gas through the bypass conduit sections 324 and 328 or, in the alternative, allowing such bypass to occur. One suitable means for retaining the shuttle element 336, in either of the positions thereof, may conveniently take the form of a ball detent element 344 which is located within a detent receiving receptacle or bore 346 defined in the body structure 332. A compression spring 348 urges the ball detent 344 toward the shuttle element 336. As shown in FIG. 3, the enlargement 342 of the shuttle is positioned above the ball detent 344. Thus, the ball detent functions to prevent free downward movement of the shuttle element. A sealing element 350, retained within a sealed groove formed in the shuttle enlargement 342, establishes sealing engagement with the inner wall 352 of the shuttle chamber 334. In this position, communication between bypass segments 324 and 328 is blocked by means of the enlargement 342 and, therefore, bypassing of gas between the upper and lower portions of the cylinder 176 cannot occur.

It is also desirable to insure positive movement of the shuttle valve element 336 in correspondence with movement of the piston element 204 within the cylinder 176. One suitable means for accomplishing such interrelated movement is achieved by interconnection of a valve operator projection 354 with the piston and shaft 236 externally of the linear motor cylinder structure. The projection 354 is secured to the piston shaft 236 by means of a set screw 356 or by any other suitable means of connection. By loosening and tightening the set screw, the position of the projection 354, relative to the piston shaft 236, may be adjusted in order to accomplish adjustable positioning of the shuttle valve 336. A valve actuator rod 358 extends through an internal passage 360 defined in the shuttle valve 336. The valve actuator rod 358 incorporates upper and lower valve positioning elements 362 and 364 that are positioned in spaced relation. Positioning element 362 is located at the upper extremity of the valve actuator rod while positioning element 364 is located intermediate the extremities of the rod. Positioning elements 362 and 364 may be formed integrally with the rod, if desired, or, in the alternative, may be attached to the valve actuation rod in any suitable manner. The lower extremity 366 of the valve actuator rod is secured to an upper shoulder portion 368 of the valve actuator projection 354 and, thus, the rod is caused to move in unison with the piston shaft and projection 354. As the piston 204 reaches the upper portion of its upward stroke, the rod will move upwardly, causing the lower valve actuating element 364 to move into contact with the lower extremity 370 of the shuttle valve 336, thereby moving the shuttle valve upwardly. As the piston 204 reaches the upper limit of its upward stroke, as shown in FIG. 3, the shuttle valve element 336 will have been moved maximum upper limit also shown in FIG. 3. In the position shown in FIG. 3, the enlargement 342 of the shuttle valve is interposed between bypass connections 338 and 340 and, thereby, blocks communication between bypass sections 324 and 328.

The piston 204 then begins moving downwardly under the influence of high pressure from the high pressure supply vessel 52 under control of one of the cam actuated valves 106. The high pressure gas is transmitted through conduit 110 and end cap 194 into the upper portion of the cylinder 176 above the piston 204. The high pressure gas, therefore, bears against the upper portion of the piston 204 and drives the piston downwardly thereby also causing the piston shaft 236 to be driven downwardly and thereby imparting rotational movement to the crankshaft 100. As the piston shaft 236 moves downwardly, valve actuating projection 354 also moves downwardly and through its interconnection with rod 358, moves the valve actuating rod downwardly. After a certain portion of the downward piston movement has occurred, the valve actuating rod 358, moving in unison with piston and piston shaft, moves the valve actuating portion 362 thereof into engagement with the upper extremity 372 of the shuttle valve 336. Continued downward movement of the piston causes the valve actuating rod 358 to move the shuttle valve downwardly, forcing the annular enlargement 342 thereof past the spring biased detent 344. As the piston 204 reaches its limit of downward travel, the shuttle valve 336 will have moved to its limit of downward travel within the valve chamber 334 thereby positioning the enlargement 342 below the opening to bypass connection 340. Communication between bypass sections 324 and 328 is, thus, established and pressure within the upper portion of the cylinder 176 will then be bypassed to the lower portion of the cylinder. The lower connection 330 of bypass section 328 is a check valve mechanism incorporating a check valve 374 that is urged against a valve seat by means of a compression spring 376. The pressurized fluid medium is allowed to flow past the check valve 374 in the direction of the flow arrow shown but is prevented from flowing in the opposite direction.

It is, thus, apparent that the shuttle valve 336 is opened in accordance with a timing sequence determined by movement of the valve actuating rod 358 as the piston nears its lower limit of downward travel thus venting the upper portion of the cylinder into the bypass system and, thus, terminating the power stroke induced to the crankshaft by means of the piston and piston shaft. The shuttle valve then remains open until such time as the piston reaches the upper portion of its upward travel, whereupon the shuttle valve is then closed so that a subsequent power cycle then may be initiated. Although the bypass valve mechanism is shown in the drawings as being a lineraly movable shuttle valve, it should be borne in mind that the present invention is not, in any way, restricted to the particular valve mechanism that is illustrated in the drawings. For example, the bypass valve may conveniently take the form of a cam energized poppet valve without departing from the spirit and scope of the present invention. The bypass valve mechanism may, therefore, take any suitable form convenient to accomplishing blocking of the bypass system at a certain portion of piston travel and opening of the bypass system during other portions of piston travel.

OPERATION

Assuming the high pressure supply vessel 52 to be pressurized to its operational pressure range and also assuming the operational supply vessel 44 to also be pressurized to its operational pressure range, the pressurized gaseous medium is conducted to the inlet portions of the engine 12. Under selective control of the cam mechanism of the engine or other suitable valve actuating mechanism, the inlet valves will sequentially admit operational pressure into the cylinders thereby inparting linear movement to the piston and, thus, rotational movement to the crankshaft 32. The converter system establishes a modified exhaust atmosphere in the exhaust manifold which is controlled by the vacuum valve 76 and ballast vessel 70. The exhaust of the cylinders is directed to a ballast vessel 70 and thence into an exhaust manifold conduit 68 across the vacuum valve 76. The exhaust of the engine 12 is, thereby, transmitted to the gas compressors of the gas converter system which achieve recompression of the exhaust gas and transmission of the recompressed gas to the high pressure supply vessel 52. As mentioned above, the linear gas compressors are energized by the crankshaft 100 of the gas converter system which receives its operational power from a plurality of sequentially energized linear gas motors that are operated responsive to movement of a plurality of control valves 106 which sequentially communicate the high pressure supply lines 110–116 with the high pressure manifold conduit 108. The exhaust of the linear gas motors 78–84 is, in turn, communicated via manifold conduit 126 to the operational supply vessel 44 for the reason that the exhaust pressure of the linear gas motors is within the operational pressure range of vessel 44.

To accommodate power losses due to seal leakage, frictional forces and the power output of the engine 18, an exhaust gas recompressor 170, which is powered in any suitable manner such as by an auxilliary source, recompresses the exhaust gas of conduit 68 and repressurizes the high pressure supply vessel 52. Additionally, a compressor 164, which is driven by the crankshaft 100, is provided with an intake 165 in communication with the atmosphere. The compressor 164 has its outlet 168 in communication with the high pressure supply vessel 52, also for the purpose of resupplying pressure losses of the high pressure vessel.

The gas energized engine system of this invention is essentially a closed-loop feedback system wherein each component is functionally related to other components for integrated operation. Energy looses that occur are replenished by introduction of additional pressurized gas, representing introduction of energy to the system.

As mentioned above, it is important to note that the converter system is essentially a gas energized engine that is coupled integrally with gas compressors for operation of the compressors. The converter utilizes a crankshaft to establish power conversion from a plurality of linear motors to a plurality of linear gas compressors. The gas energized engine also employs a crankshaft and accomplishes transfer of energy from the pistons to the crankshaft for the rotary power output of the engine. The crankshafts of the converter and the gas driven engine are not connected in any manner whatever.

The gas energized engine system described herein operates as a substantial "closed-loop system" and takes on the characteristics of a servomechanism system. Its operation can be described by the use of simultaneous basic feedback equations as follows:

$$C=GR/(1+HG)$$

where

C is the control variable

R is the reference variable

H is the feedback transfer function

G is the forward transfer function

The pressure within high pressure vessel 52 is supposed to remain constant, but the pressure in tank 44 can vary *above* the pressure defined by regulator 55 and that variance forms the feedback path to the converter power cylinders 78, 80, 82 and 84.

The pressure in the ballast vessel 70 can theoretically vary from a perfect vacuum to an upper limit of the pressure of tank 44. This pressure variance of tank 70 provides the feedback path for the servosystem comprised of gas energized engine 12 and ballast vessel 70.

Both of the above feedback loops are restored additively by converter compression cylinders 128, 130, 132 and 134.

As in any servosystem, be it electrical or pneumatic, the operation technique of the Laplace transformation can be used to arrive at the complex pressures within this engine system. The damping factor, damping ratio and the undamped natural frequency of the system can be treated in like manner.

While the foregoing is directed to the preferred embodiment of the present invention, other and further embodiments of the invention may be devised without departing from the basic concept thereof, and the scope thereof is determined by the claims which follow.

I claim:

1. A gas energized engine system comprising:

(a) a gas energized reciprocating piston type engine, said engine having gas intake means and gas exhaust means having valved communication with cylinders within which the pistons of said engine reciprocate;

(b) an operational gas supply system being interconnected with the gas intake means of said engine and supplying compressed gas for operation of said engine, said operational gas supply system comprising:

(1) a high pressure gas supply vessel;

(2) an operational gas supply vessel;

(3) supply lines communicating said operational gas supply vessel with said gas intake means of said engine;

(4) pressure regulated passage means interconnecting said operational gas supply vessel and said high pressure gas supply vessel and maintaining a predetermined operational pressure within said operational gas supply vessel;

(c) a gas converter system having inlet means receiving the exhaust gas of said gas exhaust means, said gas converter system having a plurality of gas compression cylinders each having a piston movably disposed therein and a drive shaft connected to said piston and extending from said cylinder, a rotatable crank shaft being interconnected with said drive shaft and imparting linear reciprocation thereto, said compression cylinders having an inlet and discharge and compressing said exhaust gas to said gas supply system, said converter system having a plurality of linear gas motors each having a cylinder with a piston movably positioned therein, said piston having a motor shaft extending therefrom and being connected in driving relation with said crank shaft, valve controlled conduit means extending from said gas supply system and supplying compressed gas to said linear gas motors, motor discharge conduit means interconnecting the discharge of said linear gas motors with said operational gas supply system, said inlet of said gas compression cylinders being communicated with the exhaust of said gas energized engine and developing a modified exhaust atmosphere in the exhaust system of said gas energized engine; and (d) auxiliary compressor means having an inlet interconnected with said gas exhaust means of said gas energized engine and a discharge connected to said gas supply system, said compressor means cooperating with said converter system to maintain said gas supply system within the operating pressure range thereof.

2. A gas energized engine system as recited in claim 1, including:

a ballast system being interconnected with said exhaust means of said gas energized engine, said ballast system receiving said exhaust and communicating said exhaust to said gas compression cylinders of said converter system at a pressure estabished by said modified exhaust atmosphere.

3. A gas energized engine system as recited in claim 1, wherein:

said linear gas motor means incorporate valve means, said valve means being closed upon movement of said motor piston means to one extremity of its reciprocating stroke and being opened upon movement of said motor piston means to the opposite extremity of its reciprocating stroke.

4. A gas energized engine system as recited in claim 3, wherein:

(a) said linear gas motor means defines end wall means at each extremity thereof; and (b) said valve means engage respective ones of end wall means upon movement of said piston means to respective extremities of its reciprocating stroke thus moving said valve means to the respective open and closed positions thereof to control the flow of compressed gas through said piston means.

5. A gas energized engine system as recited in claim 4, wherein:

retainer means retains said valve means in respective ones of said open and closed positions relative to said piston means during piston travel within said linear gas motor means, said retainer means releases said valve means upon forcible movement thereof by said end wall means.

6. A gas energized engine system as recited in claim 5, wherein said retainer means comprises:

(a) retainer recess means being formed in said valve means; and (b) detent means being carried by said piston means and entering said retainer recess means at the open and closed position of said valve means and establishing a releasably locked relationship between said valve means and said piston means.

7. A gas energized engine system as recited in claim 4, wherein:

(a) said end wall means defining an inlet opening at one extremity of said linear gas motor means and a discharge opening at the opposite extremity of said linear gas motor means; and (b) said inlet opening being in selectively controlled communication with said gas supply system.

8. A gas energized engine system as recited in claim 1, wherein:

(a) said linear gas motor means incorporates a bypass passage means communicating one extremity of said cylinder motor means with the opposite extremity thereof; and (b) bypass valve means being movably positioned in said bypass passage means and being operative responsive to movement of said piston means for selective communication of opposed extremities of said linear gas motor means through said bypass passage means.

9. A gas energized engine system as recited in claim 8, wherein said bypass passage means comprises:

(a) a first bypass passage section being in communication with one extremity of said linear gas motor means;

(b) a second bypass passage section communicating with the opposite extremity of said linear gas motor means; and (c) said bypass valve means being movable to an open position allowing communication between said first and second bypass sections and a closed position blocking communication between said first and second bypass sections.

10. A gas energized engine system as recited in claim 9, wherein said bypass valve means comprises:

(a) a valve body defining a valve chamber, said first and second bypass passage sections being in communication with said valve chamber;

(b) a shuttle valve being movably positioned within said valve chamber, said shuttle valve blocking communication of said first and second bypass passage sections in said closed position; and (c) operator means being interconnected with said piston shaft and being operative to selectively position said shuttle valve at said open and closed positions thereof responsive to movement of said piston shaft.

11. A gas energized engine system as recited in claim 10, wherein:

(a) opposed extremities of said shuttle valve protrude from said valve body; and (b) said operator means defines spaced valve actuating means positioned for operating engagement with respective extremities of said shuttle valve; the spacing of said valve actuating means controlling opening and closing of said shuttle valve means as said piston means approaches the limits of its reciprocating stroke.

12. A gas energized engine system as recited in claim 11, wherein:

(a) said shuttle valve incorporates a locking projection; and (b) retainer means is positioned in yielding relation within said valve body, said retainer means engaging said locking projection to releasably retain said shuttle.

13. A gas energized engine system as recited in claim 8, wherein:

(a) said piston means defines a high pressure side in communication with said high pressure supply and a low pressure side opposite said high pressure side; and (b) check valve means is incorporated within said bypass passage means and allows unidirectional flow of gas through said bypass passage means into said linear gas motor means on said low pressure side of said piston means.

14. A gas energized engine system as recited in claim 1, wherein:

said gas energized engine and said converter are separate and independent functioning mechanisms; and said gas supply system includes a conduit system interconnecting said gas energized engine, said gas supply system and said converter system.

15. A gas energized engine system as recited in claim 14, wherein:

said gas supply system is interconnected with said gas energized engine and said converter system in such manner as to define a substantially closed loop gas transmission system wherein each component thereof is functionally interdependent upon operation of other components thereof.

16. A gas energized engine system as recited in claim 1, wherein:

(a) high pressure gas supply means is provided for operation of said motor means;

(b) a plurality of control valves establish selective communication of said high pressure supply means with respective ones of said motor means; and (c) valve actuating means is operated by said converter crankshaft and achieves sequential operation of said control valves responsive to rotation of said converter crankshaft.

17. A gas energized engine system comprising:

(a) a piston type engine having compressed gas intake means and gas exhaust means;

(b) an operational pressure vessel containing gas for engine energization and being in communication with said intake means of said engine;

(c) pressure regulator means maintaining an operating pressure range within said operational pressure vessel;

(d) a high pressure vessel being in gas supplying connection with said pressure regulator means;

(e) pneumatic cylinder compressor means having a valve controlled intake in communication with said gas exhaust means of said engine and having a compressed gas discharge in communication with said high pressure vessel;

(f) pneumatic cylinder drive motor means having an inlet in communication with said high pressure vessel and an outlet in communication with said operational pressure vessel;

(g) timing valve means interposed between said high pressure vessel and said drive motor means, said timing valve means inducing sequential operation of said drive motor means;

(h) crank shaft means being rotatably mounted and having driving interconnection with said compressor means and driven interconnection with said drive motor means, said crank shaft means having controlling interconnection with said timing valve means; and (i) auxiliary gas compressor means having an inlet in communication with said exhaust means of said engine and a discharge in communication with said high pressure vessel.

18. A gas energized engine system as recited in claim 17, wherein:

(a) said pneumatic cylinder drive means comprising pneumatic cylinder motor means having motor piston means located for reciprocation within said cylinder motor means and piston shaft means establishing a driving interconnection between said motor piston means and said converter crankshaft; and (b) said pneumatic cylinder compressor means comprising pneumatic cylinder compressor means having compressor piston means located for reciprocation within said second cylinder motor means and piston shaft means establishing a driven interconnection between said compressor piston means and said converter crankshaft.

19. A gas energized engine system as recited in claim 17, wherein said pneumatic cylinder drive motor means comprises:

(a) pneumatic cylinder motor means defining inlet and outlet means;

(b) piston means being positioned for reciprocation within said cylinder motor means;

(c) piston shaft means establishing driving interconnection between said piston means and said crankshaft;

(d) passage means interconnecting said inlet means and said high pressure vessel;

(e) said timing valve means controlling supply of pressurized gas from said high pressure vessel, said valve means being selectively opened and closed responsive to rotation of said crankshaft and resulting in selective energization of said pneumatic cylinder motor means for imparting powered rotation of said crankshaft; and (f) said outlet means being in communication with said operational pressure vessel.

20. A gas energized engine system as recited in claim 19, wherein said pneumatic cylinder compressor means comprises:

(a) pneumatic compressor cylinder means defining intake means and discharge means;

(b) compressor piston means being positioned for reciprocation within said compressor cylinder means;

(c) compressor shaft means establishing driven interconnection between said compressor piston means and said crankshaft;

(d) said intake of said pneumatic compressor being in communication with said gas exhaust of said gas energized engine; and (e) said discharge means being in communication with said high pressure vessel.

21. A gas energized engine system as recited in claim 20, including;

means maintaining said gas exhaust at a low pressure range from a vacuum condition to slightly above atmospheric pressure.

22. A gas energized engine system as recited in claim 20, wherein:

an exhaust passage interconnects the exhaust means with said intake of said pneumatic compressor means; and a vacuum valve is interconnected within said exhaust passage and functions to maintain the intake pressure of said compressor means within a low pressure range from a vacuum condition to slightly above atmospheric pressure.

23. A gas energized engine system as recited in claim 22, including:

a ballast vessel being interconnected within said exhaust passage means and functioning to minimize pressure surges within said exhaust passage means.

24. A gas energized engine system as recited in claim 20, including:

a resupply compressor being connected in driven relation with said converter crankshaft, said resupply compressor having a discharge being interconnected with said high pressure vessel.

25. A gas energized engine system as recited in claim 20, including:

a resupply compressor having an inlet interconnected with atmosphere and a discharge interconnected with said high pressure vessel and adapted to resupply pressure depleted from said high pressure vessel.

* * * * *